US006980751B2

(12) United States Patent
Wayman et al.

(10) Patent No.: US 6,980,751 B2
(45) Date of Patent: Dec. 27, 2005

(54) DEVELOPER HUMIDIFIER

(75) Inventors: William H. Wayman, Ontario, NY (US); Barrett L. Gady, Rochester, NY (US); Jean A. Maksymiak, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 111 days.

(21) Appl. No.: 10/231,839

(22) Filed: Aug. 29, 2002

(65) Prior Publication Data

US 2004/0042815 A1 Mar. 4, 2004

(51) Int. Cl.[7] ..... G03G 21/20
(52) U.S. Cl. ..... 399/97
(58) Field of Search ..... 399/94, 97, 91, 399/44

(56) References Cited

U.S. PATENT DOCUMENTS 5,481,339 A * 1/1996 De Cock et al.
5,539,500 A * 7/1996 Hamamichi et al. ..... 399/97
5,937,226 A 8/1999 Kim ..... 399/44
5,953,571 A 9/1999 Thompson ..... 399/290
6,023,600 A * 2/2000 Julien et al.
6,311,958 B1 * 11/2001 Stanek
6,582,868 B2 * 6/2003 Urabe
2001/0012048 A1 * 8/2001 Kinjyou
2002/0093687 A1 * 7/2002 Kerby ..... 399/97

FOREIGN PATENT DOCUMENTS

EP 0 629 931 A1 12/1994
JP 59042567 A * 3/1984 ..... G03G 15/08
JP 01100547 A * 4/1989 ..... G03D 17/00
JP 04349473 A * 12/1992 ..... G03G 15/00
JP 05019579 A * 1/1993 ..... G03G 15/00
JP 06019293 A * 1/1994 ..... G03G 15/08
JP 10319630 A * 12/1998 ..... G03G 9/087

* cited by examiner

*Primary Examiner*—Susan Lee
(74) *Attorney, Agent, or Firm*—Lloyd F. Bean, II

(57) ABSTRACT

An apparatus for developing a latent image recorded on a movable imaging surface, including: a reservoir for storing a supply of developer material including toner particles; a donor member being arranged to receive toner particles from the reservoir and to deliver toner particles to the image surface at locations spaced apart from each other in the direction of movement of the imaging surface thereby to develop the latent image thereon; and a humidification system, associated with the reservoir, for maintaining the supply of developer material at a predefined humidity.

4 Claims, 3 Drawing Sheets

DEVELOPER HUMIDIFIER

This invention relates to a method and apparatus for maintaining the humidity of developer material in a developer housing at predefined set point. Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles tribo-electrically charged and adhering thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems.

Hybrid scavengeless development technology develops toner via a conventional magnetic brush onto the surface of a donor roll and a plurality of electrode wires are closely spaced from the toned donor roll in the development zone. An AC voltage is applied to the wires to generate a toner cloud in the development zone. This donor roll generally consists of a conductive core covered with a thin (50–200 micron) partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700–900 Vpp at frequencies of 5–15 kHz. These AC signals are often square waves, rather than pure sinusoidal waves. Toner from the cloud is then developed onto the nearby photoreceptor by fields created by a latent image.

Two-Component developer typically consists of 5–15 micron insulating toner particles, which are mixed with 50–100 micron conductive magnetic carrier granules. The developer material may comprise from about 95% to about 99% by weight of carrier and from 5% to about 1% by weight of toner.

The mixing of the developer material generates toner charge through tribo-electrification with the carrier granules.

It is well known that tribo-electrification is strongly influenced by the environmental conditions, specifically the Relative Humidity. At low RH the toner tribo-electric charge will be higher in magnitude and at high RH the toner will be lower in charge magnitude.

To maintain optimum image quality it is desirable to control the toner charge within an optimum range. To do this environmental controls are typically required to maintain the machine's ambient temperature and relative humidity. In the past, Manufacturers have put limits on the acceptable customer temperature and RH extremes before installing machines. If a location is outside the specified limits, then the customer is notified that he must install/upgrade his HVAC system or find a more suitable location.

However HVAC control is expensive and may not be available or viable in some customer locations.

There is provided an apparatus for developing a latent image recorded on a movable imaging surface, including: a reservoir for storing a supply of developer material including toner particles; a donor member being arranged to receive toner particles from said reservoir and to deliver toner particles to the image surface at locations spaced apart from each other in the direction of movement of the imaging surface thereby to develop the latent image thereon; and a humidification system, associated with said reservoir, for maintaining said supply of developer material at a predefined humidity.

There is also provided a printer having an apparatus for developing a latent image recorded on a movable imaging surface, including: a reservoir for storing a supply of developer material including toner particles; a donor member being arranged to receive toner particles from said reservoir and to deliver toner particles to the image surface at locations spaced apart from each other in the direction of movement of the imaging surface thereby to develop the latent image thereon; and a humidification system, associated with said reservoir, for maintaining said supply of developer material at a predefined humidity.

There is also provided a method for maintaining a supply of developer material at a predefined humidity in a developer system, comprising storing a supply of developer material including toner particles in a reservoir; pumping air into said reservoir, and adding moisture to said pumped air.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawing. In the drawing, like reference numerals have been used throughout to designate identical elements.

Figure 1:
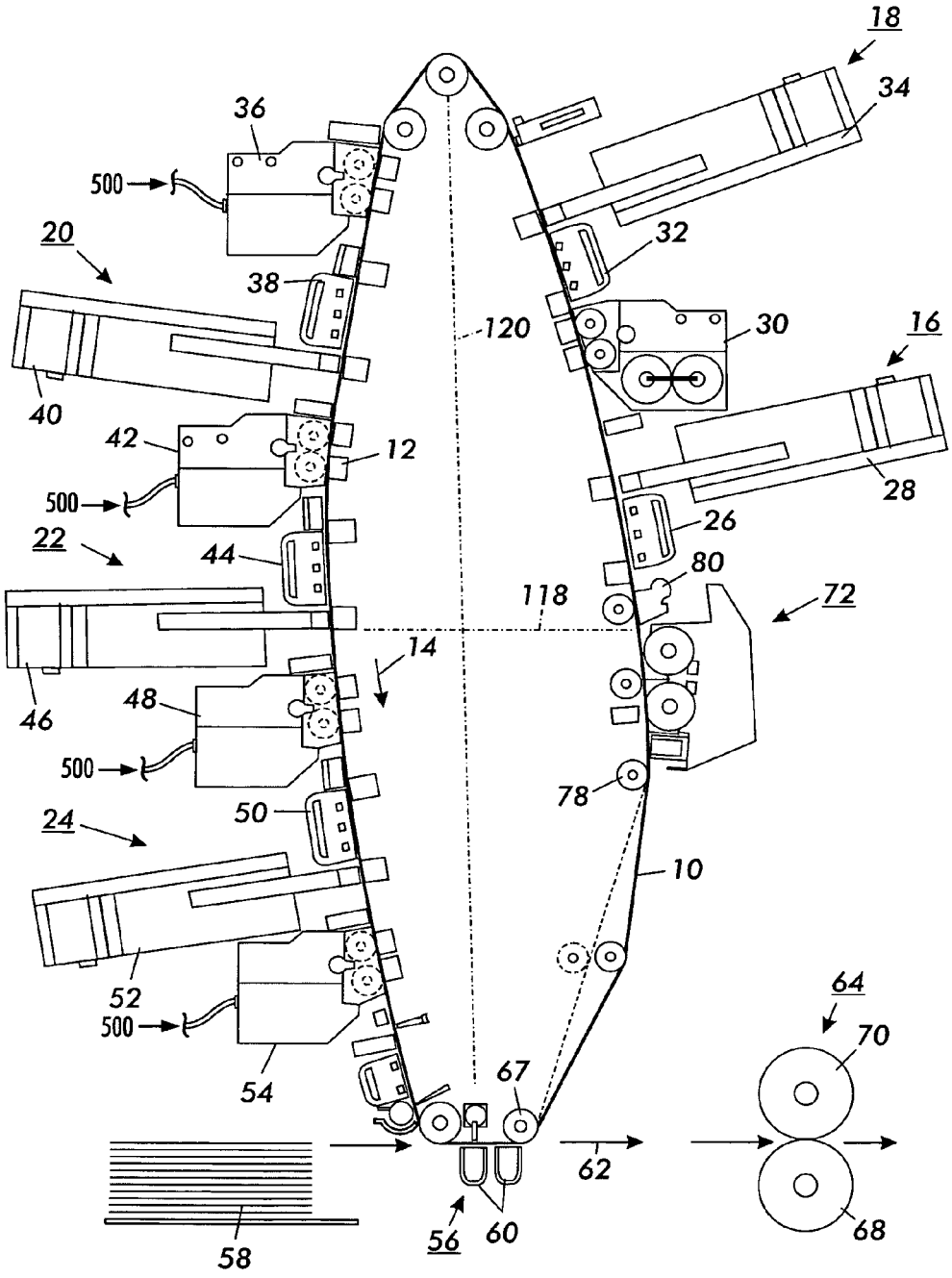
FIG. 1 is a schematic view of an illustration single pass multi-color electrophotographic machine.

Referring now to FIG. 1, there is shown a single pass multi-color printing machine. This printing machine employs a photoconductive belt 10, supported by a plurality of rollers or bars. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt has a major axis 120 and a minor axis 118. The major and minor axes are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes including a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the magenta developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 67 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a backup roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Figure 2:
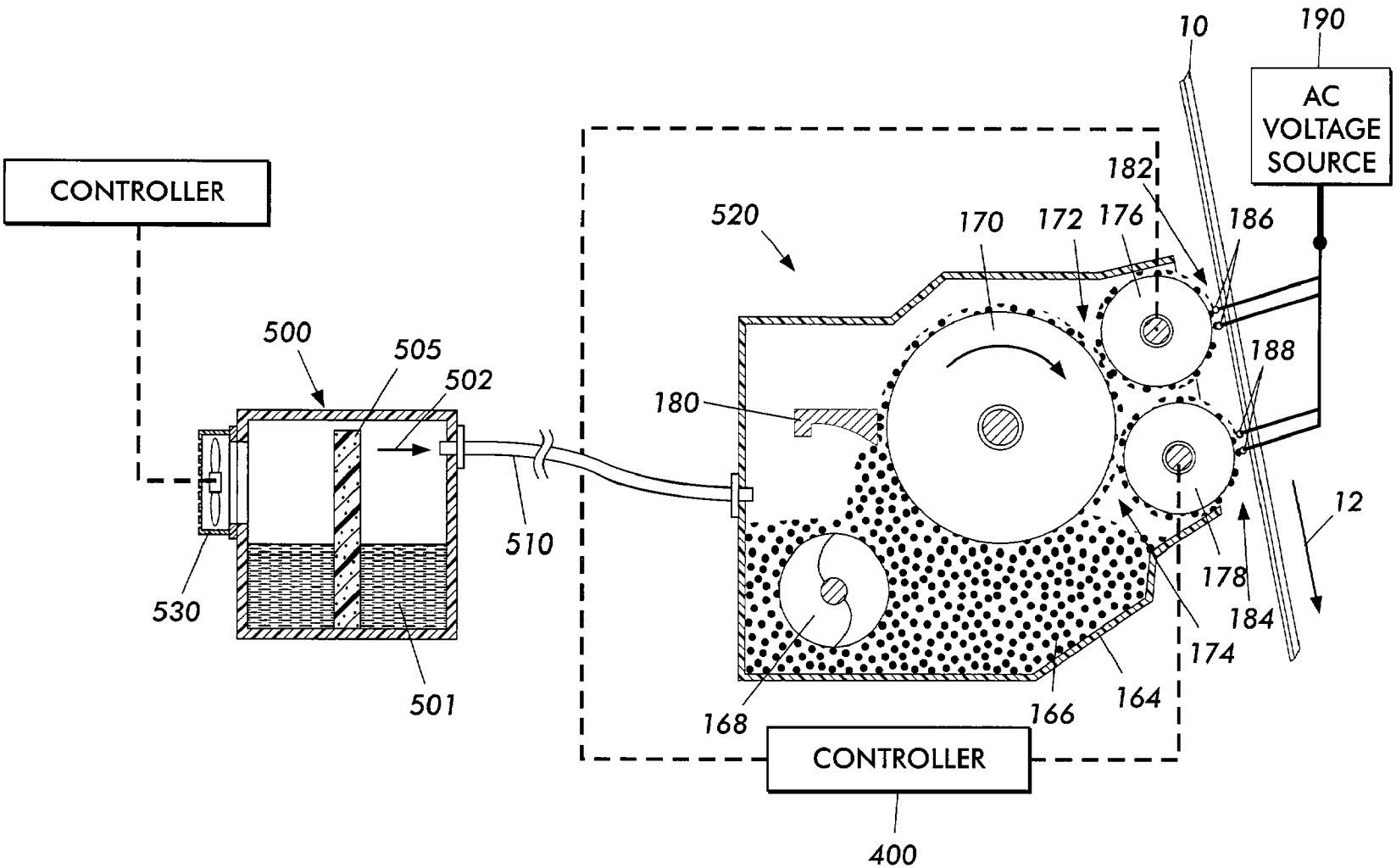
FIGS. 2 and 3 are schematic elevation views of a development apparatus having features of the present invention.

Referring now to FIG. 2, there are shown the details of the development apparatus. The apparatus comprises a reservoir 164 containing developer material 166. The developer material 166 is of the two component type, that is it comprises carrier granules and toner particles. The reservoir includes augers, indicated at 168, which are rotatably-mounted in the reservoir chamber. The augers 168 serve to transport and to agitate the material within the reservoir and encourage the toner particles to charge tribo-electrically and adhere to the carrier granules. A magnetic brush roll 170 transports developer material from the reservoir to the loading nips 172, 174 of two donor rolls 176, 178. Magnetic brush rolls are well known, so the construction of roll 170 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 170 rotates, the granules (with toner particles adhering triboelectrically thereto) are attracted to the roll 170 and are conveyed to the donor roll loading nips 172, 174. A metering blade 180 removes excess developer material from the magnetic brush roll and ensures an even depth of coverage with developer material before arrival at the first donor roll loading nip 172. At each of the donor roll loading nips 172, 174, toner particles are transferred from the magnetic brush roll 170 to the respective donor roll 176, 178.

Each donor roll transports the toner to a respective development zone 182, 184 through which the photoconductive belt 10 passes. Transfer of toner from the magnetic brush roll 170 to the donor rolls 176, 178 can be encouraged by, for example, the application of a suitable D.C. electrical bias to the magnetic brush and/or donor rolls. The D.C. bias (for example, approximately 70 V applied to the magnetic roll) establishes an electrostatic field between the donor roll and magnetic brush rolls, which causes toner particles to be attracted to the donor roll from the carrier granules on the magnetic roll.

The carrier granules and any toner particles that remain on the magnetic brush roll 170 are returned to the reservoir 164 as the magnetic brush continues to rotate. The relative amounts of toner transferred from the magnetic roll 170 to the donor rolls 176, 178 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At each of the development zones 182, 184, toner is transferred from the respective donor roll 176, 178 to the latent image on the belt 10 to form a toner powder image on the latter. Various methods of achieving an adequate transfer of toner from a donor roll to a photoconductive surface are known and any of those may be employed at the development zones 182, 184.

In FIG. 2, each of the development zones 182, 184 is shown as having the form i.e. electrode wires are disposed in the space between each donor roll 176, 178 and photoconductive belt 10. FIG. 2 shows, for each donor roll 176, 178, a respective pair of electrode wires 186, 188 extending in a direction substantially parallel to the longitudinal axis of the donor roll. The electrode wires are made from thin (i.e. 50 to 100 micron diameter) stainless steel wires which are closely spaced from the respective donor roll. The wires are self-spaced from the donor rolls by the thickness of the toner on the donor rolls. The distance between each wire and the respective donor roll is within the range from about 5 micron to about 20 micron (typically about 10 micron) or the thickness of the toner layer on the donor roll. An alternating electrical bias is applied to the electrode wires by an AC voltage source 190.

The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10. The magnitude of the AC voltage in the order of 200 to 500 volts peak at frequency ranging from about 8 kHz to about 16 kHz. A DC bias supply (not shown) applied to each donor roll 176, 178 establishes electrostatic fields between the photoconductive belt 10 and donor rolls for attracting the detached toner particles from the clouds surrounding the wires to the latent image recorded on the photoconductive surface of the belt.

As successive electrostatic latent images are developed, the toner particles within the developer material 166 are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir. The auger 168 in the reservoir chamber mixes the fresh toner particles with the remaining developer material so that the resultant developer material therein is substantially uniform with the concentration of toner particles being optimized. In this way, a substantially constant amount of toner particles is in the reservoir with the toner particles having a constant charge.

The two-component developer 66 used in the apparatus of FIG. 2 may be of any suitable type. However, the use of an electrically conductive developer is preferred because it eliminates the possibility of charge build-up within the developer material on the magnetic brush roll which, in turn, could adversely affect development at the second donor roll. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

The present invention includes a humidifier system, associated with said developer reservoir, for controlling the developer material relative humidity. Said humidifier system includes a source of water vapor and a means to introduce this vapor into the developer sump. The humidifier system further includes a sensor 407 for sensing the relative humidity of the supply of developer material. The controller 400 selectively activates and deactivating the developer humidifier based on the sensor reading of developer sump relative humidity.

Alternatively the sensor can be eliminated and the decision to add or not add humidity to the developer could be obtained from the xerographic process control system. By example, if the developer bias required for a given density goes outside a predetermined limit, then the developer humidifier would be enabled or disabled.

The details of one embodiment are shown in FIG. 2. A tank 500 partially containing liquid water 501 and also containing an evaporative wick 505 is connected by tubing 510 to the developer housing 520. A fan 530, mounted on the side of the tank 500 can force air through the wetted wick which will humidify the air stream 502. This humidified air is then supplied to the developer housing sump 520 through tube 510.

The fan is enabled whenever the control system wants to raise the developer housing humidity.

Figure 3:
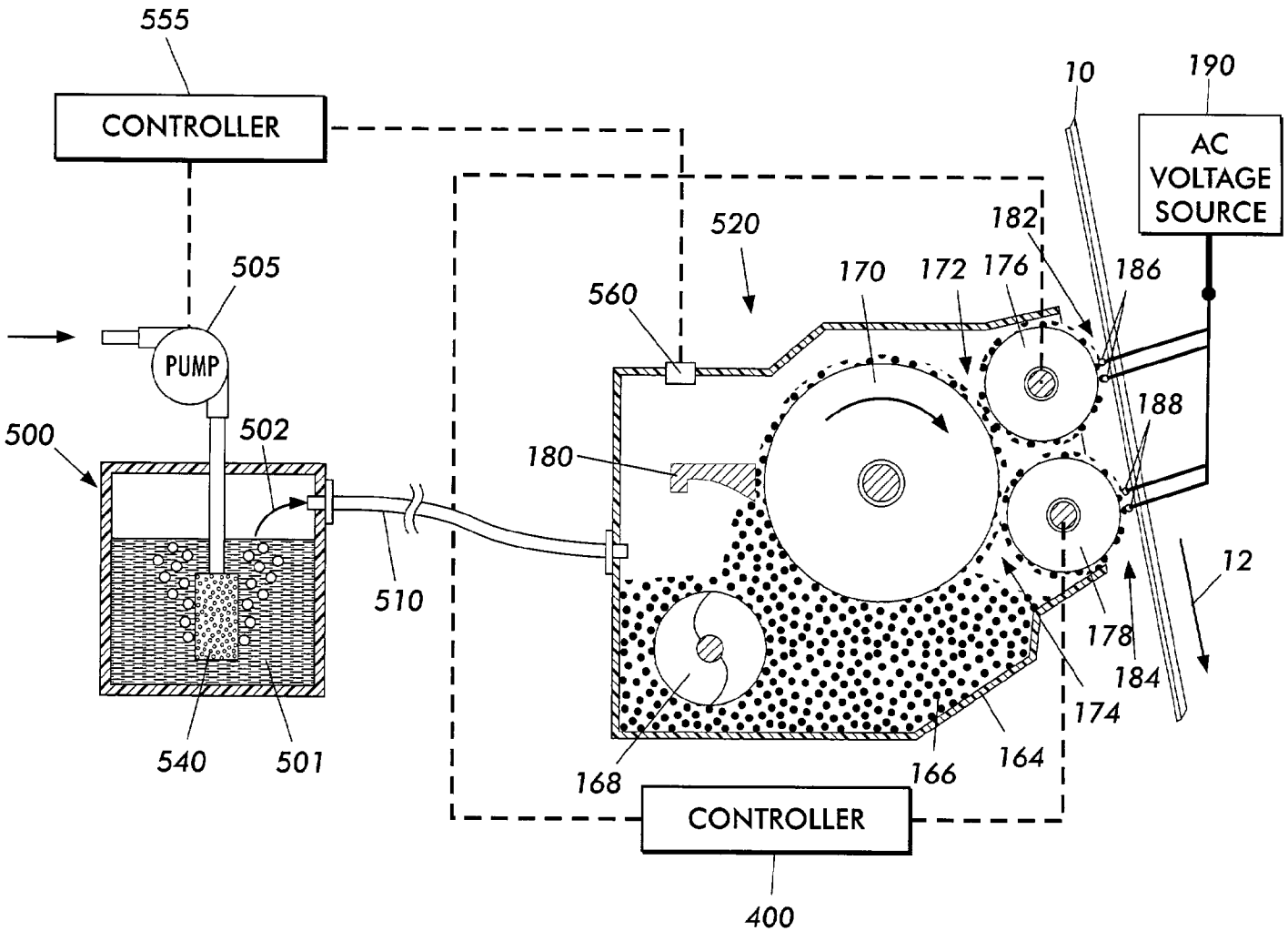

In another embodiment shown in FIG. 3, a tank 500 partially containing water 501 includes a submerged porous-stone 540 connected by tubing to an air pump 505. When the pump is activated air is forced out the pores of the stone forming bubbles thus humidifying the air. This humidified air is then supplied to the developer housing sump 520 through tube 510. The pump is enabled/disabled by a controller 555 based on the reading of humidity sensor 560.

Applicants have found that control of developer humidity is required to maintain acceptable image quality, especially in very dry environments (below about 15% RH).

In very dry environments the toner charge increases to the point where developability is reduced beyond what the xerographic process control system can accommodate. Humidification of the developer material in low RH machine environments is required to keep the image quality within acceptable limits and ultimately the machine in operation.

Humidification of only the developer material (vs. the entire machine) is advantaged for cost and simplicity. This way the machine can control the toner charge itself instead of being at the mercy of the outside environment.

It is, therefore, apparent that there has been provided in accordance with the present invention which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A method for maintaining a supply of developer material at a predefined humidity in a developer system, comprising:

storing a supply of developer material including toner particles in a reservoir;

pumping air into said reservoir, adding moisture to said pumped air;

monitoring the humidity level in said reservoir;

controlling developability of a latent image with a xerographic control system; and selectively activating and de-activating said adding, in response to said xerographic control system.

2. An apparatus for developing a latent image recorded on a movable imaging surface, including:

a reservoir for storing a supply of developer material including toner particles;

a donor member being arranged to receive toner particles from said reservoir and to deliver toner particles to the image surface at locations spaced apart from each other in the direction of movement of the imaging surface thereby to develop the latent image thereon;

a humidification system, associated with said reservoir, for maintaining said supply of developer material at a predefined humidity; said humidification system includes a humidity sensor in the said reservoir, said humidification system further includes an air pump for pumping air into said reservoir, and means for adding moisture to said pumped air; and a xerographic control system for controlling developability of the latent image, wherein said humidification system is selectively activating and de-activating, in response to said xerographic control system.

3. The apparatus of claim 2, wherein said moisture adding means includes a porous-stone bubbler immersed in a liquid.

4. The apparatus of claim 2, wherein said humidification system further includes a controller in communication with air pump, said sensor, said controller selectively activating and de-activating air pump, based on the humidity sensed by said sensor.

* * * * *